United States Patent [19]

Stauffer

[11] 4,020,975

[45] May 3, 1977

[54] WALL-MOUNTABLE DISPENSING DEVICE FOR BULK AND ENCAPSULATED MATERIALS

[76] Inventor: R. Thomas Stauffer, 813 E. Vine St., Apt. 202, Murray, Utah 84107

[22] Filed: Aug. 21, 1975

[21] Appl. No.: 606,614

[52] U.S. Cl. ..... 222/93; 222/95; 222/105

[51] Int. Cl.[2] ..... B65D 35/56

[58] Field of Search ..... 222/93, 95, 105, 390, 222/386.5, 181, 569, 131, 326, 327

[56] References Cited

UNITED STATES PATENTS

| | | | |
|---|---|---|---|
| 971,818 | 10/1910 | Barker | 222/93 |
| 2,461,211 | 2/1949 | Guthrie | 222/390 X |
| 2,627,365 | 2/1953 | Gabler | 222/390 X |
| 2,627,999 | 2/1953 | Swan | 222/95 |
| 3,185,345 | 5/1965 | Hunegs | 222/390 X |
| 3,407,968 | 10/1968 | Fiquet et al. | 222/105 X |
| 3,815,787 | 6/1974 | Spies | 222/95 |

*Primary Examiner*—Robert B. Reeves
*Assistant Examiner*—John P. Shannon
*Attorney, Agent, or Firm*—J. Winslow Young; H. Ross Workman

[57] ABSTRACT

A dispenser for semiliquid materials. The dispenser includes a cylindrical housing which is wall-mountable and which has an upper, closed end and a downwardly opening open end. The housing has a column coaxial within the housing attached to the closed end. The column serves as a fixed piston in cooperation with a cup which is threadedly engaged with the housing to telescopically sheath the piston. Rotation of the cup telescopically moves the cup over the piston thereby displacing the material in the cup through a spout in the base of the cup. The material may be either encapsulated and the capsule placed in the cup or the cup may serve as a container for a bulk quantity of material.

6 Claims, 4 Drawing Figures

WALL-MOUNTABLE DISPENSING DEVICE FOR BULK AND ENCAPSULATED MATERIALS

BACKGROUND

1. Field of the Invention

This invention relates to dispensers for liquid materials and, more specifically, semiliquid type materials.

2. The Prior Art

The phrase, semiliquid materials, is defined herein to mean those materials which will flow or pour under the action of gravity alone and also those materials which will flow under the pressures obtainable by the structure of the present invention. Semiliquid materials such as toothpaste, shampoo, hand creme, detergents, hand cleaners, and the like are commercially available in a wide variety of containers. These containers include tubes, jars, bottles, and the like and constitute a storage, access, and handling problem due to the various shapes and configurations for the containers.

Numerous dispensing devices are available, for example, see U.S. Pat. Nos. 1,286,875; 1,447,400; 1,607,501; and 2,788,158. Various other devices accommodate collapsible tubes for dispensing toothpaste, for example, see U.S. Pat. Nos. 971,818; 2,762,525; 2,937,790; 3,172,569; and 3,241,721.

In view of these various dispensers, what is needed is a relatively uncomplicated dispensing apparatus for dispensing semiliquid material wherein the material is readily accessible. As a further convenience, the dispenser should be wall-mountable and readily accommodate recharging and, advantageously, accommodate interchangeability of materials to be dispensed therefrom. Such an invention is disclosed herein.

BRIEF SUMMARY AND OBJECTS OF THE INVENTION

The present invention is a dispenser apparatus having structure which accommodates the delivery of a liquid and, preferentially, semiliquid materials in preselected quantities. The structure forces the material from the dispenser proportionately to the degree of rotation of an element of the dispenser. The structure also accommodates the interchange of semiliquid materials to adapt the dispenser apparatus as a dispenser for different types of semiliquid materials.

It is therefore a primary object of this invention to provide improvements in dispensers for semiliquid materials.

It is another object of this invention to provide a dispenser for semiliquid materials which accommodates a capsule of semiliquid material.

An even further object of this invention is to provide a dispenser which serially accommodates different types of semiliquid materials.

An even further object of this invention is to provide a wall-mountable, semiliquid materials dispenser.

These and other objects and features of the present invention will become more fully apparent from the following description and appended claims taken in conjunction with the accompanying drawing.

DETAILED DESCRIPTION OF THE PREFERRED EMBODIMENTS

The invention is best understood by reference to the figures wherein like parts are designated with like numerals throughout.

Figure 1:
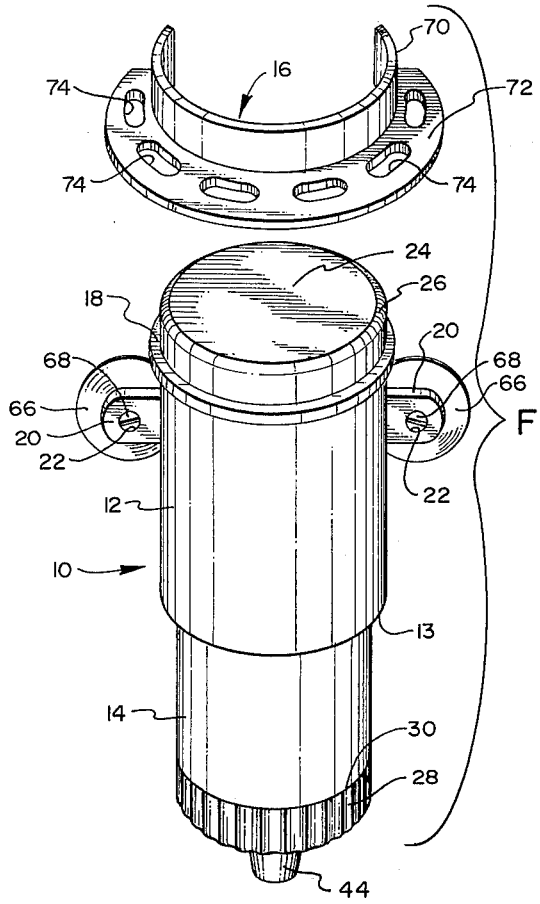
FIG. 1 is a perspective illustration of one presently preferred embodiment of the dispenser of this invention in conjunction with an accessory fixture.

Referring now to FIG. 1, the dispenser is shown generally at 10 and includes a cylindrical housing 12 adapted to telescopically receive a cup 14. Housing 12 has a closed end 24 with a smoothly contoured edge 26 which permits water to flow off end 24. Housing 12 is wall-mountable by a bracket 20 having apertures 22 therethrough for attaching the bracket 20 to a wall (not shown). Bracket 20 is configurated to receive suction cups 66 attached to bracket 20 by means of screws 68. Although suction cups 66 are shown for mounting dispenser 10 to a wall (not shown), other systems for mounting dispenser 10 could be accommodated, for example, by removing suction cups 66 from apertures 22 and screwing bracket 20 directly to a wall through apertures 22.

A raised ridge 18 extends circumferentially around the upper end of housing 12 and serves as a stop for a fixture 16. Fixture 16 includes a semicircular, wall 70 whose internal surface slidably mates with the external surface of housing 12. The bottom edge of fixture 16 abuts ridge 18 when fixture 16 is placed on the upper end of housing 12. The height of wall 70 is sufficient to extend above surface 24 when the wall 70 is placed in abutment with ridge 18 thereby forming an article receiving basin at the upper end of housing 12. The basin thus formed serves to hold accessory articles such as dental floss dispensers, fingernail brushes and the like.

A laterally extending shelf 72 circumferentially circumscribes a portion of the periphery of housing 12. Shelf 72 includes a plurality of article receiving apertures 74 for suspending articles such as toothbrushes and the like from the shelf 72.

Figure 2:
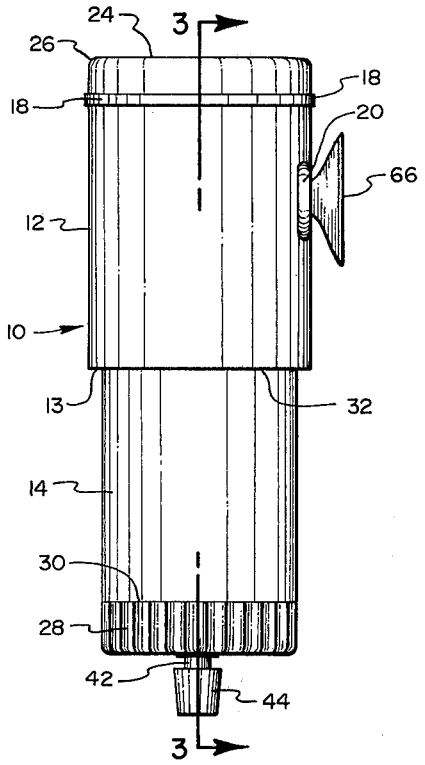
FIG. 2 is a side elevational view of the dispenser of FIG. 1.

Referring now to FIG. 2, a spout 42 is shown extending downwardly from the base of cup 14 and has a cap 44 serving as a closure therefrom. Removal of cap 44 and rotation of cup 14 permits selective dispensing of materials from cup 14 of dispenser 10.

Cup 14 includes a knurled section 28 which facilitates finger gripping and rotation of cup 14 as will be discussed more fully hereinafter with reference to operation of the dispenser 10. The upper edge of knurled section 28 serves as a marker 30 in cooperation with bottom edge 13 of housing 12 to indicate when all of the contents within cup 14 have been expelled.

Figure 3:
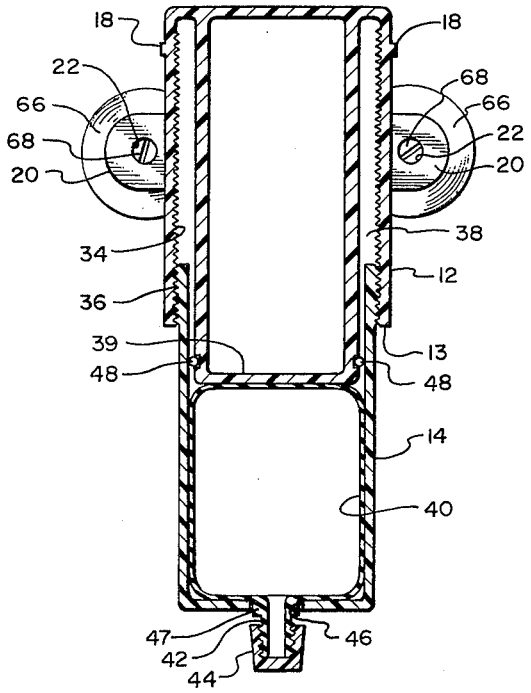
FIG. 3 is a cross section taken along lines 3—3 of FIG. 2.

Referring now to FIG. 3, the cooperation between cup 14 and housing 12 is more clearly shown. The upper, outer edge of cup 14 includes a threaded section 36 which threadedly engages threads 34 of housing 12.

A fixed piston 38 is concentrically located within housing 12 and cooperates with cup 14 to expel the semiliquid materials (not shown) from within cup 14. The end of piston 38 is closed at 39 and includes a circumferentially extending seal in the form of an O-ring 48. The function of the O-ring 48 is to prevent materials within cup 14 from being forced between the internal wall of cup 14 and piston 38.

Disposed within cup 14 is a materials capsule 40 from which depends spout 42. Spout 42 extends through hole 46 in the base of cup 14 and is closed by cap 44. Preferentially, hole 46 is rectangular and base 47 of spout 42 is also rectangular to mate therewith to prevent rotation of capsule 40 when cap 44 is removed and replaced on the end of spout 42.

Figure 4:
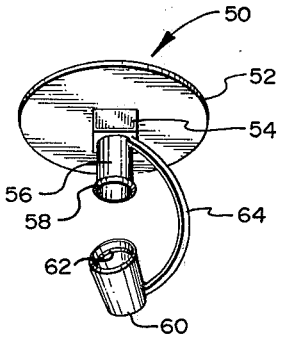
FIG. 4 is a perspective view of a second spout embodiment for the dispenser.

Referring now more particularly to FIG. 4, a second spout embodiment is shown generally at 50 and includes a disc 52 with a rectangular boss 54 serving as the base for a spout 56. Spout 56 terminates in a circumferential lip 58 which serves to engage the snap rim 62 in a spout cap 60. Spout cap 60 is tethered to spout 56 by a tether 64.

The alternate embodiment of the spout shown at 50 is configurated to be received in the base of cup 14 when the capsule 40 has been removed therefrom. With capsule 40 removed from cup 14, and spout embodiment 50 placed therein, cup 14 is configurated to receive semiliquid materials in bulk form. Accordingly, as cup 14 is rotated and telescopically moves into housing 12, O-ring 48 seals the internal walls of cup 14 while surface 39 of piston 38 displaces the bulk materials (not shown) downwardly through spout 56. The materials contained within cup 14 are dispensed cleanly and in proportion to the degree of rotation of cup 14 thereby permitting a controlled dispensing of the materials.

Dispenser 10 may also be used for encapsulated semiliquid materials which would be encapsulated in capsule 40. If desired, the cup 14 may be threadedly disengaged from housing 12 and the capsule 40 replaced with a correspondingly sized capsule of a different semiliquid material such as hand creme and the like. Threaded reengagement of the cup 14 with housing 12 again places the surface 39 of piston 38 into position to expel materials from capsule 40 as set forth previously. If desired and to prevent confusion, the capsules, spouts and caps for the capsules can be suitably color-coded for the different types of materials contained within the capsule 40 thereby providing an indication of the contents. In this manner, the dispenser serves a wide range of uses by being radially refillable and, when the system of capsules 40 is used, readily accommodates interchangeable capsules for different types of materials such as shampoo, hand creme, hand cleaner and the like.

The foregoing refill and/or replacement procedures are followed when the indicia 30 is aligned with the bottom end 13 of housing 12 thereby indicating that all of the contents of cup 14 have been dispensed.

When used as a dispenser for bulk materials, cup 14 of dispenser 10 serves as the receptacle for bulk materials dispensed from a bulk material container (not shown). Refilling of cup 14 is accomplished in the same manner as replacement of capsule 40 with the exception that there is less flexibility with respect to interchangeability of the types of materials dispensed thereby. However, cup 14 is readily removable and easily accessible for cleaning and opening 46 readily accommodates either the base 47 to the spout 42 of capsule 40 or base 54 of the second spout embodiment 50.

The fixture 16 is preferentially removed from dispenser 10 in a shower environment so that water impinging upon dispenser 10 will readily run off of end 24 and will not accumulate thereon.

The invention may be embodied in other specific forms without departing from its spirit or essential characteristics. The described embodiments are to be considered in all respects only as illustrative and not restrictive and the scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A wall-mountable dispenser for encapsulated semiliquid materials comprising:

a cylindrical housing having an open end and a closed end, the internal wall of the housing being threaded;

means for removably mounting the housing on a vertical surface with the housing in a generally vertical orientation having the open end of the housing downward;

a raised ridge circumscribing the housing adjacent the closed end;

a removable fixture for placement on the housing in abutment with the raised ridge comprising (a) a semicylindrical wall having an inside diameter dimensionally corresponding to the outside diameter of the housing and a height greater than the distance between the raised ridge and the closed end of the housing so as to form a basin at the closed end of the housing and (b) a shelf extending outwardly from the wall and having article-receiving apertures therein;

a coaxial piston fixed to the closed end of the housing and spaced from the housing wall, the piston having side walls parallel with the walls of the housing and extending an incremental distance from the open end of the housing;

a cup configurated to telescopically cooperate between the housing and the piston, the cup having thread engaging means for engaging the threaded wall of the housing, the cup having a polygonal spout receiving hole in the bottom of the cup;

a cylindrical capsule for semiliquid materials and having a spout at one end and a cap for the spout, the spout having a polygonal base dimensionally corresponding to the polygonal hole, the capsule being dimensionally configurated to be received in the cup with the spout extending through the hole in the cup and the polygonal base preventing rotation of the capsule in the cup when the cap for the capsule spout is removed and replaced; and means for moving the cup relative to the piston to squeeze the capsule between the cup and the piston to force the semiliquid materials through the spout, said means comprising a hand gripping portion around the base of the cup to accommodate hand rotation of the cup to cause a corresponding axial movement of the cup into the housing.

2. A dispenser as defined in claim 1 wherein the cup includes an outwardly visible indicia in combination with the hand gripping portion of the cup and operable in combination with the housing to indicate the quantity of semiliquid material remaining in the capsule.

3. A dispenser for encapsulated semiliquid materials comprising:

a cylindrical housing having an open end and a closed end, the internal walls of the housing being threaded;

means for removably mounting the housing on a vertical surface with the housing in a generally vertical orientation comprising at least one suction cup attached to the housing by a bracket;

a raised ridge circumscribing the housing adjacent the closed end of the housing;

a semicircular shelf removably attached to the housing, the shelf extending perpendicular to the axis of the housing and being adapted to be placed in abutment with the raised ridge;

a piston coaxial with the housing, the piston being fixed to the closed end of the housing and spaced from the housing wall, the piston extending an incremental distance beyond the confines of the housing;

a cup adapted to be telescopically received between the housing and the piston, the cup having a polygonal spout receiving hole in the bottom and thread engaging means around the lip of the cup to threadedly engage the threads of the housing;

means for forming a seal between the piston and the cup to inhibit materials in the cup from being forced from the cup between the cup and the piston;

structure selectively insertable into the cup to selectively adapt the cup to bulk and encapsulated materials comprising a separate spout embodiment operable to fit in the bottom of the cup to adapt the cup to bulk, semiliquid materials and interchangeable with a cylindrical capsule for semiliquid materials configurated to be received in the cup and be compressed between the cup and the piston, the capsule having a spout oriented to extend through the hole in the cup; and finger engaging means on the cup for hand rotation of the cup thread engaging means in mating relationship with the housing threads to accommodate axial movement of the cup against the piston to compress the capsule and force material therefrom.

4. A dispenser as defined in claim 3 wherein the shelf has an integral collar to match the contour of the housing, the collar extending beyond the closed end of the housing to thereby create a basin on the closed end of the housing.

5. A dispenser as defined in claim 3 wherein the shelf has toothbrush receiving slots therein.

6. A dispenser as defined in claim 4 wherein the shelf engages the housing in a press fit relationship and rests against the raised ridge on the housing.

* * * * *